United States Patent [19]

Knapp, Jr.

[11] 4,167,722

[45] Sep. 11, 1979

[54] ELECTRIC FUSE CONSTRUCTION

[75] Inventor: Edward J. Knapp, Jr., Merrimac, Mass.

[73] Assignee: Gould Inc., Rolling Meadows, Ill.

[21] Appl. No.: 899,738

[22] Filed: Apr. 25, 1978

[51] Int. Cl.[2] ..... H01H 85/16

[52] U.S. Cl. ..... 337/252; 337/231

[58] Field of Search ..... 337/231, 232, 251, 252, 337/254, 253

[56] References Cited

U.S. PATENT DOCUMENTS

| | | | |
|---|---|---|---|
| 3,274,426 | 9/1966 | Scoledge et al. | 337/253 |
| 3,529,271 | 9/1970 | Swain | 337/254 |
| 3,777,297 | 12/1973 | Knapp | 337/161 |

FOREIGN PATENT DOCUMENTS

| | | | |
|---|---|---|---|
| 699480 | 11/1940 | Fed. Rep. of Germany | 337/252 |
| 666024 | 9/1964 | Italy | 337/251 |

*Primary Examiner*—Harold Broome

*Attorney, Agent, or Firm*—Erwin Salzer

[57] ABSTRACT

The terminal elements of an electric fuse are made up of two separate parts of which the axially outer part is circular in cross-section and the axially inner part has a smaller area than the axially inner end surface of the axially outer part. The aforementioned two parts define ducts at the interfaces thereof. The ends of the fusible elements are inserted into these ducts. Solder joints conductively connect the ends of the fusible elements to the parts of which the terminals consist and affix the smaller of these parts to the larger of these parts.

11 Claims, 9 Drawing Figures

ELECTRIC FUSE CONSTRUCTION

BACKGROUND OF THE INVENTION

The present invention relates to an improvement of the electric fuses disclosed in U.S. Pat. No. 3,777,297; Dec. 4, 1973 to Edward J. Knapp, Jr. for ELECTRIC FUSE FOR ELEVATED CIRCUIT VOLTAGES. It is the principal object of the present invention to provide electric fuses wherein a single solder joint performs the dual function of affixing the end of a fusible element to a portion or a part of the terminal element and of conductively connecting said portion or part thereof to the main body of the terminal element. A further object of the present invention is to dispense with passages for the pulverulent arc-quenching filler between the radially inner and the radially outer surface of the part of the structure that receives the ends of the fusible element.

SUMMARY OF THE INVENTION

This invention refers to electric fuses having a casing of electric insulating material, a pair of terminal elements closing the ends of said casing, fusible elements conductively interconnecting said pair of terminal elements, and a pulverulent arc-quenching filler inside said casing surrounding said fusible elements.

According to this invention the pair of terminal elements is of a composite nature. It comprises a first pair of spaced parts circular in cross-section each having an axially inner end surface, and it further comprises a second pair of parts separate from said first pair of parts each having an axially outer end surface in physical engagement with said axially inner end surface of one of said first pair of parts. The axially outer end surface of each of said second pair of parts has a smaller area than said axially inner end surface of each of said first pair of parts so that a step is formed between each of said first mentioned and each of said second mentioned end surfaces.

Each of said second pair of parts has a predetermined volume and each of said second pair of parts has an axially inner end surface and a lateral surface precluding said pulverulent arc-quenching filler from occupying said volume.

The axially inner end surface of each of said first pair of parts and the axially outer end surface of each of said second pair of parts define ducts therebetween. In other words, the interfaces of said first pair of parts and said second pair of parts define ducts. The fusible elements have bent ends inserted into said ducts.

Solder joints each perform the dual function of bonding each of said second pair of parts to one of said first pair of parts at the interface thereof and of conductively connecting the ends of said fusible elements to the walls of said ducts.

DESCRIPTION OF PREFERRED EMBODIMENT

Figure 1:
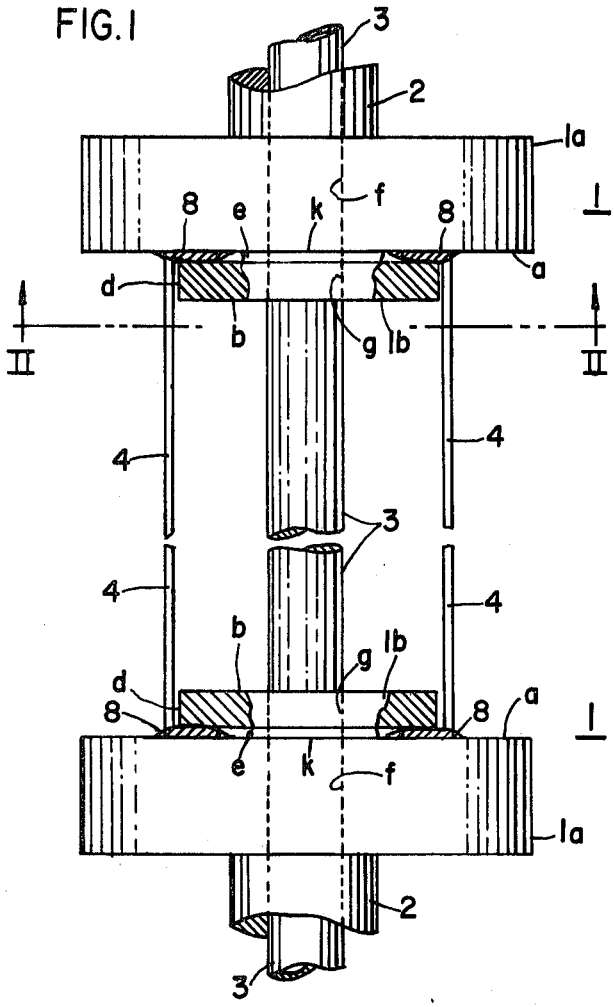
FIG. 1 is a front view of a fuse structure in the process of assembly.

Referring now to the drawings, and more particularly to FIGS. 1, 2, 3 and 5 thereof, numeral 1 has been applied to generally indicate a pair of composite terminal elements. Terminal elements 1 comprise first parts 1*a* and second parts 1*b* and tubular extensions 2 project axially outwardly from said first parts 1*a*. Reference character a has been applied to indicate the axially inner end surfaces of first parts 1*a*, and reference character b has been applied to indicate the axially inner and reference character k has been applied to indicate the axially outer end surface of each second part 1*b*. End surfaces a and k are in physical engagement except where end surfaces k are provided with grooves or recesses e. The axially outer end surfaces of each of said second parts 1*b* have a smaller area than the axially inner end surfaces a of first parts 1*a*. Assuming parts 1*a* and 1*b* to be cylindrical, then the diameter of parts 1*b* ought to be smaller than the diameter of parts 1*a*. As a result of the above described geometry, a step is formed between the axially inner end surfaces a of first parts 1*a* and the axially inner end surfaces b of second parts 1*b*.

In the embodiment of FIG. 1 both second parts 1*b* are a solid metal. This means that each of parts 1*b* has a predetermined though small volume, and that parts 1*b* have axially inner end surfaces b, and lateral surfaces d, that preclude any pulverulent arc-quenching filler—to be described later in more detail—from entering said volume.

Parts 1*a*, 1*b* define ducts e that are formed by parallel grooves in the axially inner end surfaces k of second parts 1*b* and by the axially outer planar end surfaces a of said first parts 1*a*.

A flexible pin 3 is inserted into tubular extensions 2 of first parts 1*a* and into concentric bores f and g in parts 1*a* and 1*b*. Flexible pins or roll pins 3 tend to expand and, therefore, maintain during assembly operations the upper of parts 1*a*, 1*b* in spaced relation from the lower of parts 1*a*, 1*b*.

Figure 2:
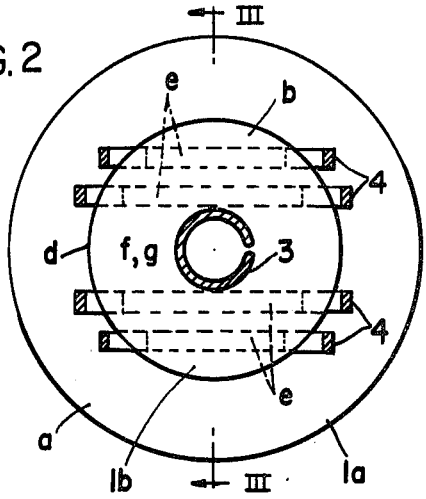
FIG. 2 is a section along II—II of the structure of FIG. 1.
Figure 3:
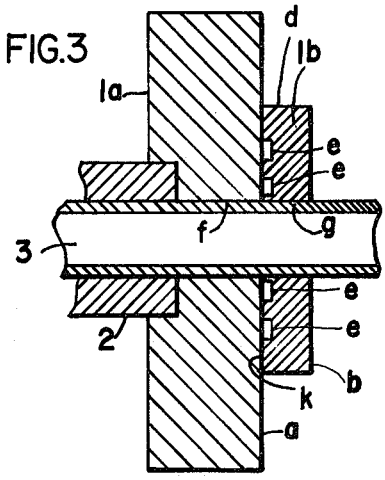
FIG. 3 is a section along III—III of the structure of FIG. 2 seen in the direction of the arrow in FIG. 2.

Reference numeral 4 has been applied to indicate a plurality of fusible elements in form of perforated metal ribbons, e.g. silver ribbons. Ribbons or fusible elements 4 are arranged in four parallel planes, as clearly shown in FIG. 2. The axially outer ends of fusible elements 4 are bent approximately 90 degrees and inserted into the open ends of passageways or ducts e. FIG. 2 shows that eight fusible elements 4 conductively interconnect the two pairs of terminal elements 1*a*, 1*b*.

Solder joints 8 are provided at the entrance of each duct e. Each of these solder joints performs the dual function of bonding one of said second parts 1*b* to one of said first parts 1*a*, and of conductively connecting the ends of fusible elements 4 to the walls of passageways or ducts e. Thus fusible elements 4 conductively interconnect the two spaced pairs of parts 1*a*, 1*b*.

Ducts e and the bent ends of fusible elements 4 exert a capillary action which results in that solder joints 8 conductively interconnect parts 1*a*, 1*b* and 4.

The above describes the first steps in assembling fuses embodying the present invention. Thereafter a tubular casing 5 of electric insulating material is mounted on parts 1*a* and secured by pins 6 to the latter. This allows withdrawal of pin 3 since the provision of casing 5 and pins 6 now effects the proper spacing of the upper parts 1*a*, 1*b* from the lower parts 1*a*, 1*b*.

Filling of the fuse with a pulverulent arc-quenching filler 7 through a bore in parts 1*a*, 1*b*, such as bores f, g and plugging of any bore which might allow the release of any sand or arc-quenching filler 7 from casing 5 completes the assembly process of the fuse.

Figure 4:
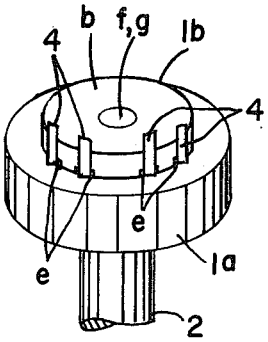
FIG. 4 is an isometric view of a detail of the structure of FIG. 1 shown on a smaller scale than FIG. 1.

FIG. 4 shows parts 1*a*, 1*b*, ducts or passageways e, fusible elements 4, their bent ends and the insertion of the latter into the openings of ducts or passageways e. In FIG. 4 but four out of the eight fusible elements 4 of FIG. 2 have been shown.

Figure 5:
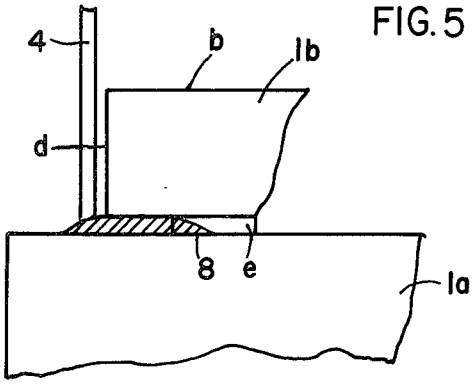
FIG. 5 shows on a relatively large scale one of the solder joints connecting constituent parts of the fuse.

FIG. 5 shows on a larger scale the electroconductive interconnection of parts 1*a*, 1*b* and 4 by solder joints 8.

Figure 8:
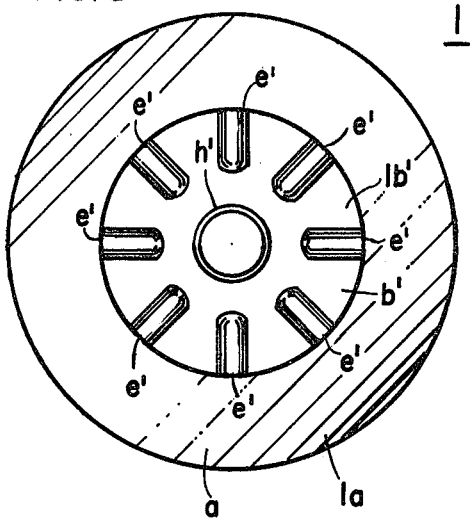
FIG. 8 is a top plan view of a modification of a detail of the structure of FIG. 6.
Figure 9:
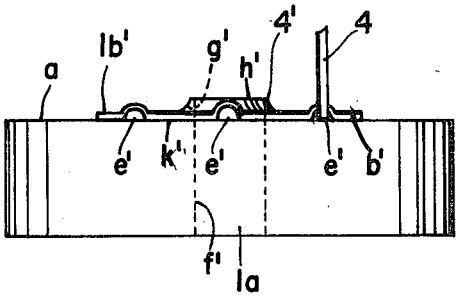
FIG. 9 shows that detail in elevation.
Figure 7:
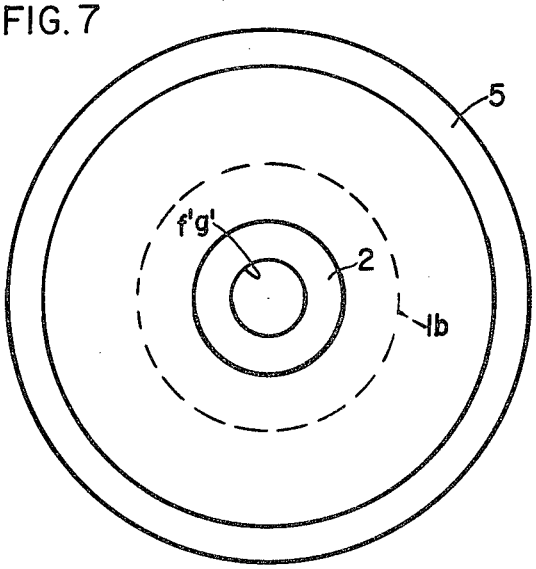
FIG. 7 is a top-plan view of the structure shown in FIG. 6.

The second part 1*b* shown particularly in FIGS. 1 to 5, may be replaced by washer-like stampings of sheet metal 1*b*′ shown in FIGS. 8 and 9. Such stampings are even less expensive to manufacture than part 1*b*.

Figure 6:
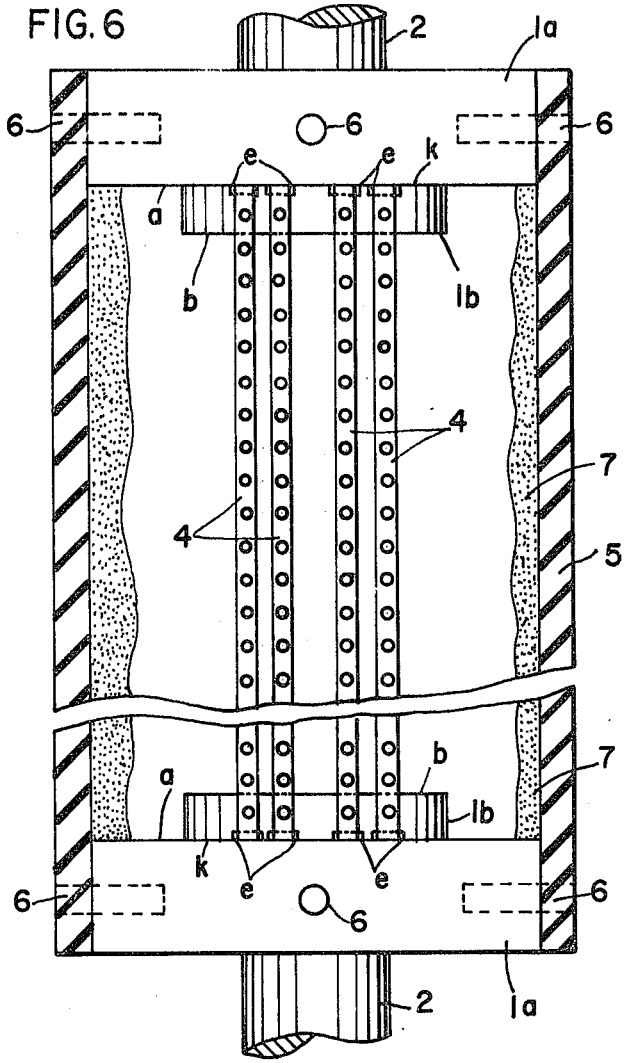
FIG. 6 is in part a longitudinal section and in part a front view of a completely assembled fuse embodying the present invention.

According to FIGS. 8 and 9 the terminal element 1 comprises a first part 1*a* which is in form of a solid metal block circular in cross-section and intended to plug the ends of a casing 5, as shown in FIG. 6. Terminal element 1 further includes a second part 1*b*′ superimposed upon the axially inner end surface a of part 1*a*. The area of end surfaces b′, k′ of part 1*b*′ is smaller than the area of the end surface a of part 1*a*. As a result, a small step is formed between parts 1*a* and 1*b*′, and the circumference of that step is equal to the circumference of parts 1*b*′ and smaller than the circumference of part 1*a*. If both parts 1*a* and 1*b*′ are substantially cylindrical, the diameter of part 1*b*′ should be smaller than the diameter of part 1*a*. Part 1*b*′ is a washer-like stamping of sheet metal. Channels or passageways e are pressed into the axially outer end surface b′ of part 1*b*′ and result in corresponding projections in the axially inner end surface b′ of part 1*b*′. Channels or passageways e′ are open at least at one end—the radially outer end—thereof and are bounded jointly by part 1*b*′ of washer-like character and the axially inner end surface a of part 1*a*. Holes f′, g′ are provided in parts 1*a*, 1*b* to allow axial spacing thereof by a radially expending pin 3, as shown in FIG. 1. In view of the thinness of part 1*b*′ the hole g thereof is surrounded by a hub-like collar h′ intended to flexibly engage rod or pin 3. Provision of such a collar is not needed in the embodiment of the invention shown in FIG. 1 because the thickness of part 1*b* exceeds that of part 1*b*′, part 1*b*′ being made of sheet metal, as mentioned above. As shown in FIG. 8 the radially inner ends of channels or ducts *e*′ are closed.

Fusible elements 4 bent at the ends thereof about 90 degrees are inserted into the radially outer open ends of channels or ducts e′, as shown at the right of FIG. 9, showing one single element out of eight elements 4 in place. The solder joints to conductively connect parts 1*a* and 1*b*′ and fusible elements 4 have not been shown in FIGS. 8 and 9. Each of these solder joints 8 performs the dual function of bonding part 1*b*′ to part 1*a* and of conductively connecting the ends of fusible elements 4 to the walls of ducts e′.

It will be noted that in FIGS. 1–6 the ducts e for receiving the ends of fusible elements 4 are arranged in parallel, while the ducts e′ in FIGS. 8 and 9 for receiving fusible elements 4 are arranged in radial relation. In FIG. 8 none of the fusible elements to be inserted into ducts e′ has been shown, while FIG. 9 shows but one of eight fusible elements 4 to be inserted into the open ends of ducts e′.

It is apparent that ducts e of FIGS. 1–6 may be arranged radially rather than in parallel, and that ducts e′ of FIGS. 8 and 9 might be arranged in parallel rather than in radial relation.

It will be also apparent that not both terminals 1*a*, 1*b* or 1*a*, 1*b*′ of a fuse must necessarily be the same. One single terminal 1*a*, 1*b* or 1*a*, 1*b*′ may be substantially the same as shown in the drawings, while the other terminals may be designed in other fashion to suit a particular purpose.

I claim as my invention:

1. An electric fuse having a casing of electric insulating material, a pair of terminal elements of metal closing the ends of said casing, fusible elements conductively interconnecting said pair of terminal elements, and a pulverulent arc-quenching filler inside said casing surrounding said fusible elements wherein (a) said pair of terminal elements comprises a first pair of spaced parts of metal circular in cross-section, each having an axially inner end surface;

(b) said pair of terminal elements further comprises a second pair of parts of metal separate from said first pair of parts each having an axially outer end surface in physical engagement with said axially inner end surface of one of said first pair of parts, said axially outer end surface of each of said second pair of parts having a smaller area than said axially inner end surface of each of said first pair of parts, each of said second pair of parts having a predetermined volume and each of said second pair of parts having an axially inner end surface and a lateral surface precluding said pulverulent arc-quenching filler from occupying said volume;

(c) ducts bounded by said axially inner end surface of one of said first pair of parts and by said axially outer end surface of one of said second pair of parts;

(d) said fusible elements having bent ends inserted into said ducts; and (e) solder joints each performing the dual function of bonding one of said second pair of parts to one of said first pair of parts at the interface thereof and of conductively connecting the ends of said fusible elements to the walls of said ducts.

2. An electric fuse as specified in claim 1 wherein said first pair of parts and said second pair of parts are solid blocks of metal, said second pair of parts being circular in cross-section and having a smaller diameter than said first pair of parts and said ducts are bounded by recesses in said axially outer end surfaces of each of said second pair of parts and the planar axially inner end surface of said first pair of parts.

3. An electric fuse as specified in claim 1 wherein said second pair of parts is of sheet metal, is circular, has a smaller diameter than said first pair of parts, and wherein said ducts are bounded by axially displaced metal of said second pair of parts and the planar axially inner end surfaces of said first pair of parts.

4. An electric fuse as specified in claim 3 wherein the center regions of the axially inner end surfaces of said second pair of parts form flexible, axial, hub-like extensions of the said second pair of parts.

5. An electric fuse including a casing of electric insulating material, a terminal element of metal closing one of the ends of said casing, a fusible element conductively connected to said terminal element and a pulverulent arc-quenching filler surrounding said fusible element wherein said terminal element comprises (a) a first part of metal circular in cross-section and plugging said casing;

(b) a second part of metal separate from said first part and superimposed upon the axially inner end surface of said first part, said second part having end surfaces of smaller area than said first part, the axially inner end surface of said second part precluding entry of said arc-quenching filler into the space occupied by said second part;

(c) a duct defined by said first part and by said second part at the interface of said first part and said second part;

(d) said fusible element having an end inserted into said duct; and (e) a solder joint performing the dual function of affixing said second part to said first part at the interface of said second part and said first part and of conductively connecting said end of said fusible element to the walls of said duct.

6. An electric fuse as specified in claim 5 wherein said first part and said second part of said terminal element are solid blocks of metal, said second part being circular and having a smaller diameter than said first part and wherein said duct is bounded by a groove in the axially outer end surface of said second part, and the planar axially inner end surface of said first part.

7. An electric fuse as specified in claim 5 wherein said second part of said terminal element is of sheet-metal, is circular in outline and has a smaller diameter than said first part, and wherein said duct is bounded by metal of said second part displaced from the axially outer end surface toward the axially inner end surface thereof, and by the planar axially inner end surface of said first part.

8. An electric fuse as specified in claim 7 wherein the center region of said second part forms an axial hub-like extension of said second part.

9. An electric fuse including a casing of electric insulating material, a terminal element of metal closing one of the ends of said casing, and a plurality of fusible elements conductively connected to said terminal element wherein said terminal element includes a first portion of relatively large diameter circular in cross-section, plugging said casing, and a second substantially cylindrical portion stacked upon the axially inner end surface of said first portion and having a smaller diameter than said first portion so that the interface between said first portion and said second portion is substantially equal to the area of said second portion, ducts defined by said first portion and said second portion at the interface of said first portion and of said second portion, said plurality of fusible elements having bent ends inserted into said ducts, and solder joints at the entrances of said ducts performing the dual function of affixing said second portion to said first portion and of conductively connecting the ends of said pluraliy of fusible elements with the walls of said ducts.

10. An electric fuse including a casing of electric insulating material, a terminal element closing one of the ends of said casing, a fusible element conductively connected to said terminal elements, and a pulverulent arc-quenching filler surrounding said fusible element wherein (a) said terminal element comprises a first portion circular in cross-section closing said casing;

(b) said terminal element further comprising a second portion superimposed upon the axially inner end surface of said first portion, said second portion having end surfaces of smaller area than the area of the axially inner end surface of said first portion, said second portion being a stamping of sheet-metal having a recess pressed into the axially outer end surface thereof and causing a corresponding bulge at the axially inner end surface thereof, said recess being open at at least one of the ends thereof, said second portion also having a hole in the center thereof and forming a flexible hub-like collar around said hole;

(c) said fusible element being in the form of a metal ribbon having one end bent approximately 90 degrees and inserted into said open end of said recess; and (d) a solder joint positioned at said open end of said recess and performing the dual function of affixing said second portion to said first portion and to establish a conductive connection between said fusible element and the walls of said recess.

11. An electric fuse as specified in claim 10 wherein said recess in said second portion is oriented radially and has radially inner closed ends.

* * * * *